US010561186B2

(12) United States Patent
Feliu De La Pena Calvo

(10) Patent No.: US 10,561,186 B2
(45) Date of Patent: Feb. 18, 2020

(54) PIECE OF FABRIC FOR HAND-SEWN WORKS AND METHOD FOR MAKING SAID WORKS WITH SAID FABRICS

(71) Applicant: DAMA INTERNACIONAL 1991, S.A., La Roca Del Valles (ES)

(72) Inventor: Jordi Feliu De La Pena Calvo, Barcelona (ES)

(73) Assignee: Dam Internacional 1991, S.A., La Roca Del Valles (ES)

( * ) Notice: Subject to any disclaimer, the term of this patent is extended or adjusted under 35 U.S.C. 154(b) by 104 days.

(21) Appl. No.: 15/739,419

(22) PCT Filed: Jun. 29, 2016

(86) PCT No.: PCT/ES2016/070487
§ 371 (c)(1),
(2) Date: Dec. 22, 2017

(87) PCT Pub. No.: WO2017/001718
PCT Pub. Date: Jan. 5, 2017

(65) Prior Publication Data

US 2018/0177256 A1 Jun. 28, 2018

(30) Foreign Application Priority Data

Jun. 30, 2015 (ES) ..... 201530936
Mar. 23, 2016 (ES) ..... 201630358

(51) Int. Cl.
*D05B 97/12* (2006.01)
*A41H 3/08* (2006.01)
(Continued)

(52) U.S. Cl.
CPC ..... *A41H 3/08* (2013.01); *B32B 7/08* (2013.01); *D03D 3/00* (2013.01); *D03D 3/04* (2013.01); *D05B 97/12* (2013.01); *D06H 7/00* (2013.01)

(58) Field of Classification Search
CPC ..... D05B 97/12; D04D 7/02
(Continued)

(56) References Cited

U.S. PATENT DOCUMENTS 4,053,986 A * 10/1977 Axelrod ..... D04D 7/02 112/475.04
4,209,857 A 7/1980 Clark, Jr.
(Continued)

FOREIGN PATENT DOCUMENTS

ES 1050524 U 4/2002
JP H11253675 A 9/1999
JP 2013241714 A 12/2013

*Primary Examiner* — Tajash D Patel
(74) *Attorney, Agent, or Firm* — Blue Filament Law PLLC

(57) ABSTRACT

A piece of fabric for manual sewing projects and method of creating said projects with said fabric, consisting of a piece (1) of cloth that incorporates, with identical or different colors, prints and/or textures, the figures (2) for creating a certain patchwork design (3), each figure (2) being marked with a seam line (4) that defines the outline thereof and a cutting line (5) that defines a perimeter border that is optionally pre-perforated. The method only comprises obtaining said piece (1), cutting the figures (2) along the cutting line (5) and sewing them together. Optionally, the patchwork design (3) is selected and the piece (1) is ordered with the desired figures (2) and colors, prints and/or textures.

12 Claims, 2 Drawing Sheets

(51) Int. Cl.

| | |
|---|---|
| ***D03D 3/00*** | (2006.01) |
| ***B32B 7/08*** | (2019.01) |
| ***D03D 3/04*** | (2006.01) |
| *D06H 7/00* | (2006.01) |

(58) Field of Classification Search
USPC ..... 112/475.08, 475.18
See application file for complete search history.

(56) References Cited

U.S. PATENT DOCUMENTS

| | | | | |
|---|---|---|---|---|
| 4,244,996 | A | 1/1981 | Maloney | |
| 4,814,218 | A * | 3/1989 | Shane | B44C 3/12 112/439 |
| 7,568,295 | B1 | 8/2009 | Strain | |
| 7,854,073 | B1 | 12/2010 | Webb | |
| 2009/0038521 | A1 | 2/2009 | Allen | |
| 2019/0127898 | A1 * | 5/2019 | Ritter | D05B 97/12 |

* cited by examiner

PIECE OF FABRIC FOR HAND-SEWN WORKS AND METHOD FOR MAKING SAID WORKS WITH SAID FABRICS

OBJECT OF THE INVENTION

The invention, as stated in the title of the present specification, relates to a piece of fabric for manual sewing projects and to the method of creating said projects with said fabric, having several advantages and characteristics, which will be described in detail further on, which imply a notable novelty in the current state of the art.

The object of the present invention is based, specifically, on a piece of fabric intended for the creation of manual sewing projects, in particular patchwork or quilting projects, and that are based on the formation of mosaics, figures or designs from joining distinct fragments of fabric, the piece of the present invention being especially designed in order to facilitate said creation.

FIELD OF APPLICATION OF THE INVENTION

The field of application of the present invention falls within the industry sector dedicated to manufacturing articles for the creation of manual projects, focusing particularly on the field of sewing projects, and more specifically patchwork projects.

BACKGROUND OF THE INVENTION

As is known, patchwork (or quilting) is a sewing technique, very widespread throughout La Rioja, which consists of joining colored scraps of cloth in order to produce different depictions, mosaics or shapes and with them, create quilts, rugs, carpets or other articles, including items of clothing, where there is space for creativity.

Said technique, however, as it has been developed until now, implies a laborious method that, apart from requiring hours of work, requires a high economic investment, and a certain expertise and initial training that, added to the resources invested, can dissuade a significant number of eventual hobbyists and, consequently, future clients for the sector.

Specifically, the current method comprises a first step, aimed at obtaining the material for producing the craft which requires a significant economic payment and time invested, time that is understood as not spent in actually doing the project, since one has to obtain the different fabrics with distinct prints, which are sold, at least, in pieces of fabric that are 25 cm along the width of the fabric (which is usually about 80 or 120 cm), hindering users who need smaller sizes, by forcing them to acquire at least said pieces. Likewise, with the purchase of the distinct fabrics, useless scraps are produced.

Furthermore, it is necessary to acquire the patterns that act as a guide to do the project. These patterns can be obtained in specialized catalogues that include designs or they can be acquired separately in shops in the sector. In any case, this implies a limitation on the variety of the types of mosaics and/or shapes that can be produced.

Once one has the necessary material, then the craft per se can be carried out. In this step, for which cutting and sewing tools are necessary (scissors, cutter, cutting boards, rulers, chalk, etc.), two distinct preparation steps are distinguished: preparing the material and the creation of the project.

Thus, after knowing the design to be executed, the first thing that must be done is choose each of the pieces or figures that will make it up, which are usually one or several shapes that are repeated many times and, after which, the distribution of the distinct fabrics previously obtained for the craft is decided. The shape must be drawn based on the chosen figure or figures, passing over the outline thereof with the pattern, over each chosen fabric, repeating this process as many times as required by the complete design. This process tends to be long and arduous, depending on the number of figures that make up the assembly of the design.

Once the outlines of the shapes are traced in the distinct fabrics, the next step is to start to cut them one by one in order to obtain each of the pieces of fabric with distinct prints that will make up the desired project, having to take care to leave enough of a margin between the seam line and the border of the fabric.

Finally, all the pieces of fabric must be sewn together with the chosen shapes in order to make up the project with the design chosen, there usually being a last step of finishing the project in order to create the blanket, quilt or element that it is for.

All of this process requires, for a person skilled in the art, approximately three hours of work for a craft of about 30×30 cm, and for a person with less knowledge about six hours of work.

Definitively, the current method for carrying out this type of project has great drawbacks: it requires a lot of time in the preparation steps; the economic investment is usually high; a high amount of waste and scraps is produced which implies the loss of a significant portion of the investment; and the variety of designs depends on the availability on the market provided by manufacturers, which limits the creativity of the user.

Therefore, the existence of a product would be desirable that enables the preparation of this type of manual sewing project, preventing the described drawbacks, the development of said product being the main objective of the present invention.

Furthermore, and regarding the current state of the art, it should be noted that the applicant at least is unaware of the existence of any piece of fabric for manual sewing projects or invention for a similar application that has technical and structural characteristics that are the same as or similar to those that this invention claims.

DESCRIPTION OF THE INVENTION

The piece of fabric for manual sewing projects and the method of creating said projects with said fabric that the invention proposes amount to a noteworthy novelty within its field of application, since by employing it one may satisfactorily reach the objectives previously mentioned as desired, the characterizing details that set it apart being duly recorded in the claims included at the end of the present specification.

Specifically, that which the invention proposes is a novel piece of fabric that, intended for carrying out manual sewing projects, in particular patchwork projects, is advantageously structured in order to greatly facilitate the process of carrying out said type of projects.

To do so, the piece of fabric of the invention is distinguished by the fact that, consisting of a piece of neutral fabric, it incorporates, preferably printed with different colors, types of prints and/or textures, the multiple figures, in one shape or in different shapes, that are needed to create a certain patchwork design, each one of said figures being clearly marked by a seam line that defines the outline thereof and provided with a perimeter border that clearly marks the cutting line thereof in order to obtain the margin required for the seams.

Therefore, the method of creating the project is notably reduced, since it prevents having to search for and acquire distinct fabrics, cut the pieces, acquire the patterns of the figures and trace the outlines of said figures on each of the different pieces of cloth in a precise and accurate manner, so that later they fit suitably in order to form the final figure, as well as calculating the space in order to leave a margin around the perimeter cutting border. The method of the invention only requires the figures to be cut and sewn to each other.

Furthermore, according to a preferred option, the cited cutting lines that each figure has on the perimeter on the piece of fabric of the invention are already pre-perforated, such that the figures with the perimeter border thereof for sewing are only joined to the piece by several easy-break points, with which the user does not need to use scissors in order to cut each of the figures, avoiding the task of cutting them by following the traced line and also preventing fraying and scissor marks that can make the project uglier or more awkward to carry out. Likewise, this option implies an additional advantage, since it prevents the user from making a mistake while cutting and instead of cutting along the line with a margin, they cut along the sewing line, therefore ruining the corresponding figure.

Continuing with the characteristics of the invention, it is worth noting that eventually the possibility of printing the figures à la carte is envisaged, such that the user themselves is the one who proposes the design and the different figures that form it as well as the different colors and prints of each figure, said proposal preferably being chosen in a catalogue with different options and combinations that the piece manufacturer itself provides.

Preferably, the seam line of each figure is recessed along the entire path by means of the application of a laser, such that the thickness of the fabric is reduced in said line with respect to the thickness in the rest of the cloth and therefore facilitates the folding of said lines that determine each figure in order to form the design. Furthermore, said recess can have a greater width than that of the line marked by means of printing or another technique in order to make said folding even easier in the formation of the designs when folding and sewing pieces together.

Also preferably, the piece has a perforation in certain parts of the perimeter border that is between the cutting line and the seam line, especially in the curved sections of the figures with curves, in order to prevent leftover cloth that causes wrinkles when sewing the designs. Preferably, this perforation has the shape of one or more wedges.

Thus, the steps of the method for creating the manual patchwork sewing project with the described piece of fabric only comprise:

- Obtaining the piece of fabric with the figures of the desired design already printed;
- Separating, by means of trimming with scissors or tearing the pre-perforated line, if present, of each figure along the printed cutting line that borders each figure with the necessary margin; and
- Sewing between each of the figures, once they are cut, along the seam line in order to form the final design.

And optionally the method will be able to envisage a prior step of selecting and/or ordering the design and figures to be printed on the piece.

In all, the invention provides a great number of clear advantages, since the user is an active protagonist in this craft. The user has the possibility of producing a product that is fully tailored and to their liking, since the different fabrics and prints or colors of the figures that make up the design can be chosen in the order, instead of having to look for fabrics with prints that go together for their design. Furthermore, it notably reduces the time required to prepare and obtain the starting materials and they are able to dedicate more time to the creativity and development of the craft.

In the fabric, preferably by means of printing, any figure from any pattern with any type of print and color will be able to be incorporated, enabling an endless number of designs to be executed.

The piece of fabric described for manual sewing projects and the method of creating them with said fabric thus consist of innovative characteristics heretofore unknown, reasons which, taken together with its usefulness, provide it with sufficient grounds for obtaining the requested exclusivity privilege.

DESCRIPTION OF THE DRAWINGS

As a complement the present description, and for the purpose of helping to make the characteristics of the invention more readily understandable, the present specification is accompanied by a set of drawings, constituting an integral part of the same, which by way of illustration and not limitation represents the following.

PREFERRED EMBODIMENT OF THE INVENTION

Figure 1:
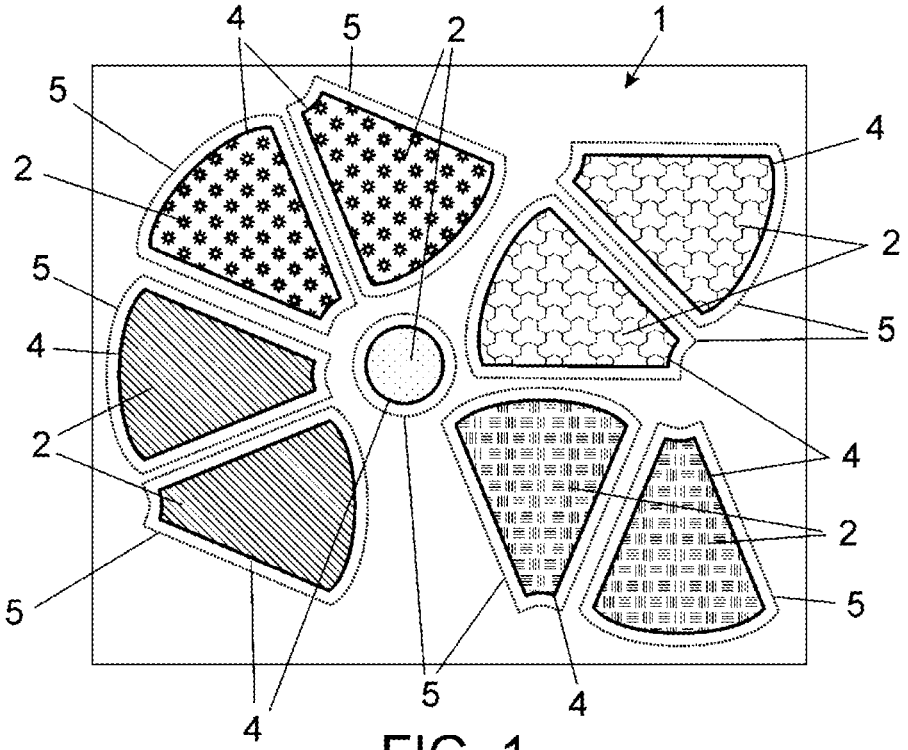
FIG. 1.—Shows a plan view of an exemplary embodiment of the piece of fabric for manual sewing projects object of the invention, showing the portions and elements that it comprises.

In light of the described figures, and in accordance with the adopted numbering, one may observe therein a non-limiting embodiment of the piece of fabric of the invention, which comprises the parts and elements indicated and described in detail below.

Thus, as seen in said figures, the piece of fabric (1) in question, intended for completing manual sewing projects, in particular patchwork or quilting projects, for all kinds of articles, such as quilts, blankets, rugs, carpets and including clothing and accessory items, incorporates, with identical or different colors, types of prints and/or textures, the multiple figures (2), with identical or different shapes, which are needed to create a certain patchwork design (3), each of said figures (2) being clearly marked with a seam line (4) that is the same one that defines the outline thereof, and indicates where the figures (2) must be sewn to each other in order to make up the design, as well as a cutting line (5) that defines a perimeter border around said outline and that indicates where the figures (2) must be cut providing the margin of cloth necessary for the seams.

Preferably, the figures (2) and/or the seam lines (4) and/or cutting lines (5) thereof are incorporated into the piece of fabric (1) by means of techniques for printing or stamping on cloth, without excluding other techniques, such as embroidering, painting or others, or a mixture thereof.

Furthermore, the cutting lines (5) of each figure (2) are optionally pre-perforated, such that they are joined to the piece (1) only by several easy-break points, avoiding the use of scissors for the separation thereof from the same.

Also preferably, the seam line (4) that defines the outline of each figure (2) has a recess (6) that runs along the entire path thereof, which, carried out by means of the application of a laser, determines the reduction of the thickness (g) of the fabric in said seam line (4) with respect to the thickness in the rest of the cloth that makes up the piece (1). Furthermore, said recess (6) in the seam line (4) either has the same width or a greater width than the width of the seam line (4) itself, marked by means of printing or another technique, as the example of FIG. 1 shows.

Finally and also preferably, the piece (1) has a perforation (7) provided in the perimeter border that is between the cutting line (5) and the seam line (4) in which it is located, especially in the curved sections of the figures (2) and preferably it is a perforation (7) in the shape of one or more wedges.

Figure 2:
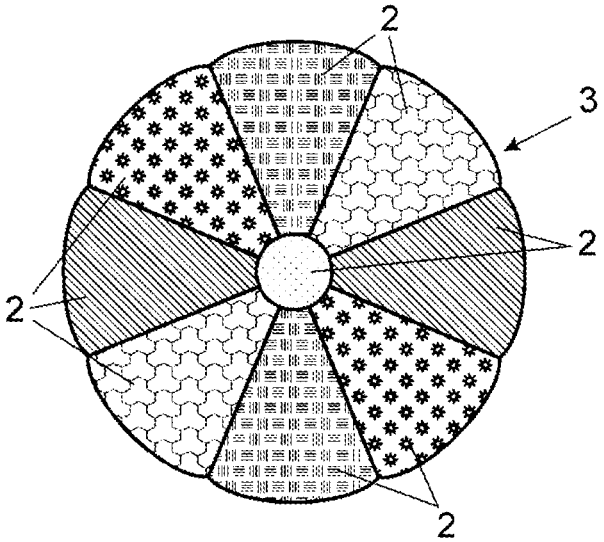
FIG. 2.—Shows a plan view of the manual sewing project created from the piece of fabric of the invention, according to the example thereof shown in FIG. 1.
Figure 3:
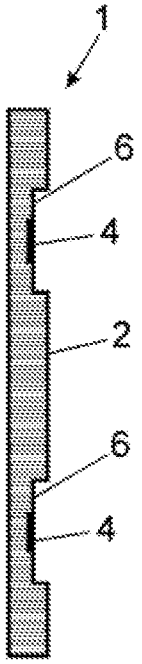
FIG. 3.—Shows a cross-sectional view of a portion of an example of the piece of fabric object of the invention, showing the recess of the piece in the path of the seam line of the figures, being represented at a larger scale and with exaggerated proportions in order to facilitate the observation thereof.
Figure 4:
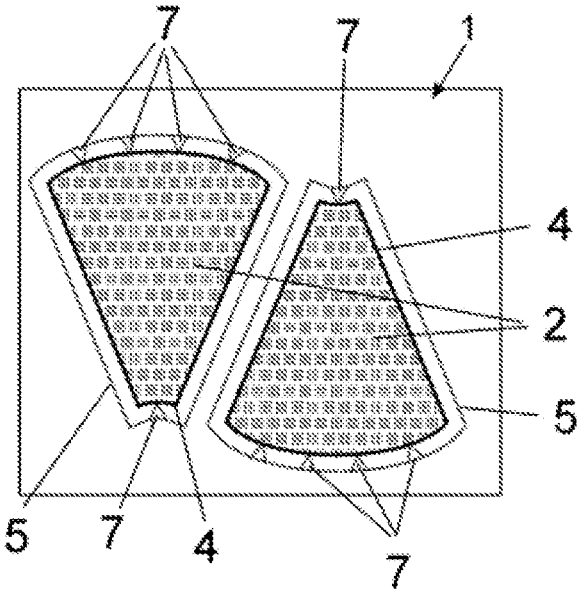
FIG. 4.—Shows a plan view of a portion of the exemplary embodiment of the piece of fabric according to the invention, to which perforations have been added in the perimeter border of some of the curved segments of the cutting lines of the figures.

In the example represented in the figures, it is seen how in order to complete the patchwork design (3) consisting of a flower made up of several petals and a central button as shown in FIG. 2, the piece of fabric (1) has the figures (2) printed in the shape of petals, which have identical profiles but with different prints, and the circular figure (2) in the shape of a button, all of these defined by seam lines (4) and with the pre-perforated cutting lines (5) which determine the perimeter border in order to sew them together, all the figures being arranged in the piece (1) occupying the same space in order to avoid leftover scraps as much as possible, as seen clearly in FIG. 1.

Therefore, the method of creating the patchwork project envisages the following steps:

Obtaining the piece of fabric (1) with the figures (2) that form a patchwork design (3) incorporated;

Trimming each figure (2) along the cutting line (5), taking into account that, when the cutting line (5) is pre-perforated, said trimming is performed by tearing and without using scissors; and Sewing all the figures (2) together along the respective seam line (4) thereof in order to form said patchwork design (3), which is the final objective desired by the user.

Optionally, a prior step is envisaged of the user selecting the patchwork design (3) and ordering from the manufacturer the creation of the piece (1) of cloth with the figures (2) that make up said design, by choosing à la carte the colors, prints and/or textures of each of said figures (2).

Having sufficiently described the nature of the present invention, as well as the ways of implementing it, it is not considered necessary to extend its explanation for any expert in the state of the art to understand its scope and the advantages which derive from it, specifying that, within its essence, it can be carried out in other embodiments that differ in detail from the one provided by way of example, and which are also covered by the requested protection, provided that they do not alter, change or modify its fundamental principle.

The invention claimed is:

1. A piece of fabric for manual sewing projects, in particular for patchwork projects for articles, comprising:

multiple figures (2) with identical or different colors and types of prints and/or textures with identical or different shapes, the multiple figures (2) being needed to create a certain patchwork design (3);

a seam line (4) that defines an outline of each of the multiple figures (2); and a cutting line (5) that defines a perimeter border around said outline and an interstitial space between said outline and the perimeter border.

2. The piece of fabric for manual sewing projects, according to claim 1, characterized in that the multiple figures (2) and/or the seam lines (4) and/or cutting lines (5) thereof are incorporated into the piece of fabric (1) by techniques for printing or stamping on cloth.

3. The piece of fabric for manual sewing projects, according to claim 1, characterized in that the multiple figures (2) and/or the seam lines (4) and/or cutting lines (5) thereof are incorporated into the piece of fabric (1) by printing or stamping on cloth, embroidering, or painting.

4. The piece of fabric for manual sewing projects, according to claim 1, characterized in that the cutting lines (5) of each of the multiple figures (2) are pre-perforated, such that these are joined to the piece of fabric (1) only by several points that are easy to break.

5. The piece of fabric for manual sewing projects, according to claim 1, characterized in that the seam line (4) that defines the outline of each of the multiple figures (2) has a recess (6) that runs along the entire path thereof, which, carried out by an application of a laser, determines a reduction of a seam line thickness (g) of the fabric in said seam line (4) with respect to a thickness in the rest of the piece of fabric (1).

6. The piece of fabric for manual sewing projects, according to claim 5, characterized in that the recess (6) in the seam line (4) has the same width as the seam line (4) itself.

7. The piece of fabric for manual sewing projects, according to claim 5, characterized in that the recess (6) in the seam line (4) has a greater width than the seam line (4) itself.

8. The piece of fabric for manual sewing projects, according to claim 1, characterized in that in curved sections of the multiple figures (2), a perforation (7) is provided in the interstitial space that is between the cutting line (5) and the seam line (4).

9. The piece of fabric for manual sewing projects, according to claim 8, characterized in that in the perforation (7) of the interstitial space between the cutting line (5) and the seam line (4) has the shape of one or more wedges.

10. A method of creating manual sewing projects, in particular patchwork or quilting projects, with a piece of fabric of claim 1, characterized in that it comprises the following steps:

Obtaining the piece of fabric (1) with the multiple figures (2) of the desired design already incorporated in the piece of fabric (1);

Trimming each of the multiple figures (2) along the respective cutting line (5) thereof; and Sewing all the figures (2) together along the seam line (4) of each of the multiple figures (2) in order to form the patchwork design (3).

11. The method of creating manual sewing projects, according to claim 10, characterized in that when the cutting line (5) is pre-perforated, the trimming is performed by tearing and without using scissors.

12. The method of creating manual sewing projects, according to claim 10, characterized in that it envisages a prior step of selecting the patchwork design (3) and ordering the creation of the piece of fabric (1) with the multiple figures (2) that make it up, and the colors, prints and/or textures of each of the multiple figures (2) that are desired.

* * * * *